US009016556B2

(12) United States Patent
Hirsh

(10) Patent No.: US 9,016,556 B2
(45) Date of Patent: Apr. 28, 2015

(54) QUICK LOCK FLAPS FOR PAPERBOARD PACKAGING

(71) Applicant: Accurate Box Company, Inc., Paterson, NJ (US)

(72) Inventor: Lisa Hirsh, Paterson, NJ (US)

(73) Assignee: Accurate Box Company, Inc., Paterson, NJ (US)

( * ) Notice: Subject to any disclaimer, the term of this patent is extended or adjusted under 35 U.S.C. 154(b) by 0 days.

(21) Appl. No.: 14/193,710

(22) Filed: Feb. 28, 2014

(65) Prior Publication Data

US 2014/0353366 A1 Dec. 4, 2014

Related U.S. Application Data

(60) Provisional application No. 61/828,756, filed on May 30, 2013.

(51) Int. Cl.

| | |
|---|---|
| ***B65D 5/10*** | (2006.01) |
| ***B65D 5/02*** | (2006.01) |
| ***B31B 5/26*** | (2006.01) |

(52) U.S. Cl.

CPC ..... *B65D 5/0254* (2013.01); *B31B 5/26* (2013.01); *B65D 5/10* (2013.01)

(58) Field of Classification Search

CPC ..... B65D 5/10; B65D 5/0254
USPC ..... 229/156, 157, 185
See application file for complete search history.

(56) References Cited

U.S. PATENT DOCUMENTS

| | | | | | |
|---|---|---|---|---|---|
| 490,167 | A | * | 1/1893 | Schmidt | 229/157 |
| 2,053,857 | A | * | 9/1936 | Weiss | 229/185 |
| 2,337,198 | A | * | 12/1943 | Holy | 229/157 |
| 2,339,224 | A | * | 1/1944 | Shina | 229/157 |
| 2,923,454 | A | * | 2/1960 | Pupke | 229/157 |
| 3,330,467 | A | * | 7/1967 | Johnson | 229/156 |
| 3,921,896 | A | * | 11/1975 | Ishimura | 229/156 |
| 4,194,679 | A | * | 3/1980 | Lohrbach et al. | 229/185 |
| 4,291,827 | A | * | 9/1981 | Mulroy | 229/156 |
| 4,367,840 | A | * | 1/1983 | McFadden | 229/157 |
| 5,328,088 | A | * | 7/1994 | Lonczak | 229/157 |
| 2002/0158114 | A1 | * | 10/2002 | Evans et al. | 229/185 |
| 2005/0023332 | A1 | * | 2/2005 | Moorman et al. | 229/157 |

* cited by examiner

*Primary Examiner* — Gary Elkins
(74) *Attorney, Agent, or Firm* — Lerner, David, Littenberg, Krumholz & Mentlik, LLP

(57) ABSTRACT

A blank for forming a container, including a first major panel, a second major panel, a first minor panel connected between the first and second major panel, a first slotted flap connected at a top edge of the first minor panel including a central region having first and second slots, a second minor panel connected to the first major panel and also connectable to the side edge of the second major panel, a second slotted flap connected at a top edge of the second minor panel including a central region having third and fourth slots, a first tabbed flap connected at the top edge of the first major panel having first and fourth tabs positioned at opposite corners of the leading edge, and a second tabbed flap connected at the top edge of the second major panel having second and third tabs positioned at opposite corners of the leading edge.

20 Claims, 3 Drawing Sheets

QUICK LOCK FLAPS FOR PAPERBOARD PACKAGING

CROSS-REFERENCE TO RELATED APPLICATIONS

The present application claims the benefit of the filing date of U.S. Provisional Patent Application No. 61/828,756 filed May 30, 2013, the disclosure of which is hereby incorporated herein by reference.

BACKGROUND OF THE INVENTION

The present invention relates to a blank for a recloseable box, as well as the recloseable box formed from the blank, and more particularly, to a blank for an improved recloseable box, as well as the improved recloseable box formed from the blank, that avoids the inconvenience associated with conventional perforated tuck slots.

Packaging for consumer products, particularly dry foods, has long required a suitable container that is easy to use and capable of being reclosed in order to prevent product spillage and help maintain product freshness. Typically, the container is a paperboard box with two overlapping flaps at a top closure, wherein one of the flaps includes a perforated cut to form a tuck slot and the other flap includes a tab along its edge to cooperate with the tuck slot, thereby allowing the container to be recloseable.

Although the above tuck slot-tab design is widely used, several potential disadvantages exist. In order to form the tuck slot, the consumer must first push through the perforated cut to complete the slot. Oftentimes, because such packages are disposable and therefore made from weak materials such as paperboard, the consumer will accidentally tear through the perforation for the tuck slot, rendering the slot incapable of retaining the tab. In addition, even if the slot is correctly formed, consumers often find it difficult to slide the tab into the slot because the tuck slots on such prior art containers are essentially a thin slit along the surface of the flap. Lastly, because the design of such containers requires that the top closure flaps overlap with one another, the manufacturers of the prior art boxes must form larger flaps, thereby using a greater amount of raw materials for each container. Thus, a need exists for a container and related blank adapted to promote easy and consistent reclosure thereof by a consumer, which costs less to manufacture and which utilizes less raw materials than boxes and packaging currently on the market.

BRIEF SUMMARY OF THE INVENTION

In one embodiment, the present invention relates to a blank for forming a carton. The blank includes a first major panel, a second major panel, a first minor panel connected between the first major panel and the second major panel, a first slotted flap connected at a top edge of the first minor panel including a central region having first and second slots, a second minor panel connected to the first major panel at an edge opposite the first minor panel and connectable to the second side edge of the second major panel, a second slotted flap connected at a top edge of the second minor panel including a central region having third and fourth slots, a first tabbed flap connected at the top edge of the first major panel and extending therefrom to a leading edge having first and fourth tabs positioned at opposite corners of the leading edge, and a second tabbed flap connected at the top edge of the second major panel and extending therefrom to a leading edge having second and third tabs positioned at opposite corners of the leading edge. Upon connecting the second minor panel to the second major panel, the first tab cooperates with the first slot, the second tab cooperates with the second slot, the third tab cooperates with the third slot, the fourth tab cooperates with the fourth slot, and the first and second tabbed flaps deflect when a compressive force is applied at a central portion of each tabbed flap such that, upon deflection of the tabbed flaps, the respective tab cooperates with the respective slot. Further, the second minor panel can be connected to the free second side edge of the second major panel. Also, the leading edges of the first and second tabbed flaps may not overlap with one another when the respective tabs are in cooperation with the respective slots.

In another embodiment, the invention relates to a container including a first major panel, a second major panel, a first minor panel, a second minor panel, a bottom enclosure, and an opening defined by top edges of the first and second major panels and first and second minor panels. The container comprises a first slotted flap connected at the top edge of the first minor panel, the first slotted flap including a central region having first and second slots; a second slotted flap connected at the top edge of the second minor panel, the second slotted flap including a central region having third and fourth slots; a first tabbed flap connected at the top edge of the first major panel and extending therefrom to a leading edge, the leading edge having first and fourth tabs positioned at opposite corners of the leading edge; and a second tabbed flap connected at the top edge of the second major panel and extending therefrom to a leading edge, the leading edge having second and third tabs positioned at opposite corners of the leading edge. The first tab cooperates with the first slot, the second tab cooperates with the second slot, the third tab cooperates with the third slot, the fourth tab cooperates with the fourth slot, and the first and second tabbed flaps deflect when a compressive force is applied at a central portion of each tabbed flap such that, upon deflection of the tabbed flaps, the respective tab cooperates with the respective slot. In another embodiment, the first and second slotted flaps and first and second tabbed flaps are connected to the top edges of the respective first and second major panels and first and second minor panels through a hinged relationship.

In another embodiment, the invention relates to a method of operating a container having a first major panel having first and second side edges and top and bottom edges, a second major panel having first and second side edges and top and bottom edges, a first minor panel connected between the second side edge of the first major panel and the first side edge of the second major panel, a first slotted flap connected at a top edge of the first minor panel, the first slotted flap including a central region having first and second slots, a second minor panel connected to the first side edge of the first major panel and connectable to the second side edge of the second major panel, a second slotted flap connected at a top edge of the second minor panel, the second slotted flap including a central region having third and fourth slots, a first tabbed flap connected at the top edge of the first major panel and extending therefrom to a leading edge, the leading edge having first and fourth tabs positioned at opposite corners of the leading edge, and a second tabbed flap connected at the top edge of the second major panel and extending therefrom to a leading edge, the leading edge having second and third tabs positioned at opposite corners of the leading edge. The container may be opened by folding the first and second slotted flaps inwardly toward an opening formed by the major and minor panels; folding the first and second tabbed flaps inwardly toward the opening and upon the first and second slotted flaps; and applying a compression force upon a central region along the leading edge of each of the first and second tabbed flaps, wherein the compression force causes a deflection in the first and second tabbed flaps such that each respective tab engages with its respective slot. Subsequently, the container may be closed by applying tension forces upon regions adjacent the first, second, third, and fourth tabs along the leading edges of each of the first and second tabbed flaps, wherein each tension force causes a deflection in the first and second tabbed flaps such that each respective tab disengages from its respective slot.

In another embodiment of the invention, the invention relates to a method of operating a container having a first major panel having first and second side edges and top and bottom edges, a second major panel having first and second side edges and top and bottom edges, a first minor panel connected between the second side edge of the first major panel and the first side edge of the second major panel, a first slotted flap connected at a top edge of the first minor panel, the first slotted flap including a central region having first and second slots, a second minor panel connected to the first side edge of the first major panel and connectable to the second side edge of the second major panel, a second slotted flap connected at a top edge of the second minor panel, the second slotted flap including a central region having third and fourth slots, a first tabbed flap connected at the top edge of the first major panel and extending therefrom to a leading edge, the leading edge having first and fourth tabs positioned at opposite corners of the leading edge, and a second tabbed flap connected at the top edge of the second major panel and extending therefrom to a leading edge, the leading edge having second and third tabs positioned at opposite corners of the leading edge. The container may be opened by folding the first and second slotted flaps inwardly toward an opening formed by the major and minor panels; folding the first and second tabbed flaps inwardly toward the opening and upon the first and second slotted flaps; and applying a compression force upon a region adjacent each of the first, second, third, and fourth tabs along the leading edge of each of the first and second tabbed flaps, wherein each compression force causes localized deflections in the first and second tabbed flaps such that each respective tab engages with its respective slot. Subsequently, the container may be closed by applying a tension force upon a region between the first and fourth tabs along the leading edge of the first tabbed flap, and applying a tension force upon a region between the second and third tabs along the leading edge of the second tabbed flap, wherein the tension forces cause localized deflections in the first and second tabbed flaps such that each respective tab disengages from its respective slot.

DETAILED DESCRIPTION

Figure 1:
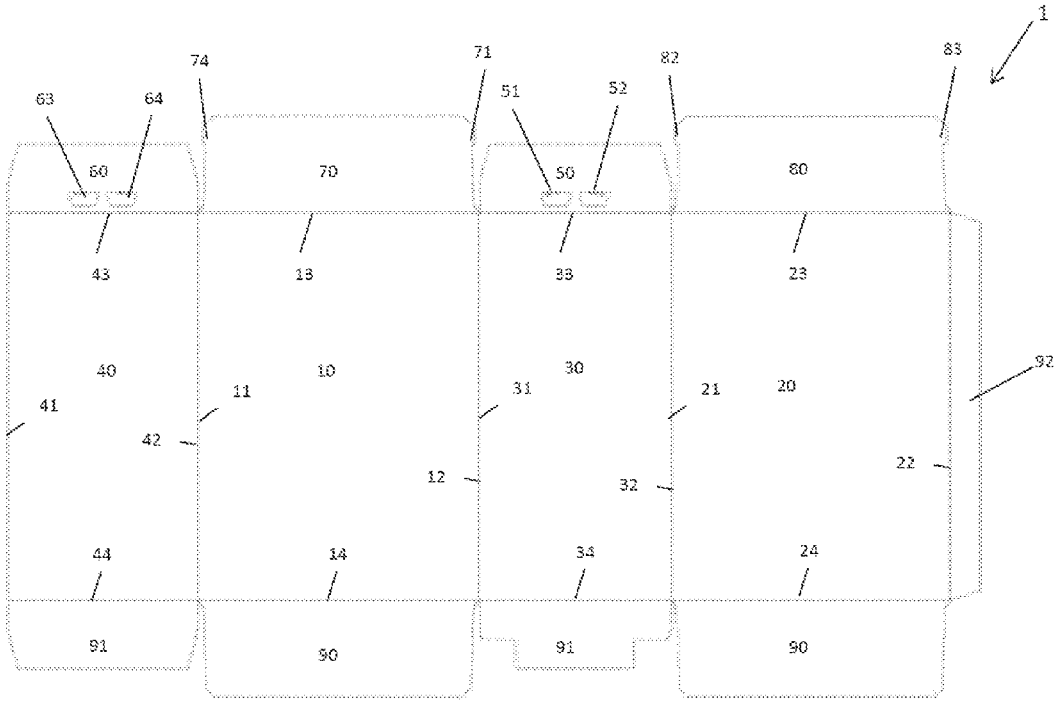
FIG. 1 is a plan view of one embodiment of a blank for forming a container in accordance with the present invention.
Figure 2:
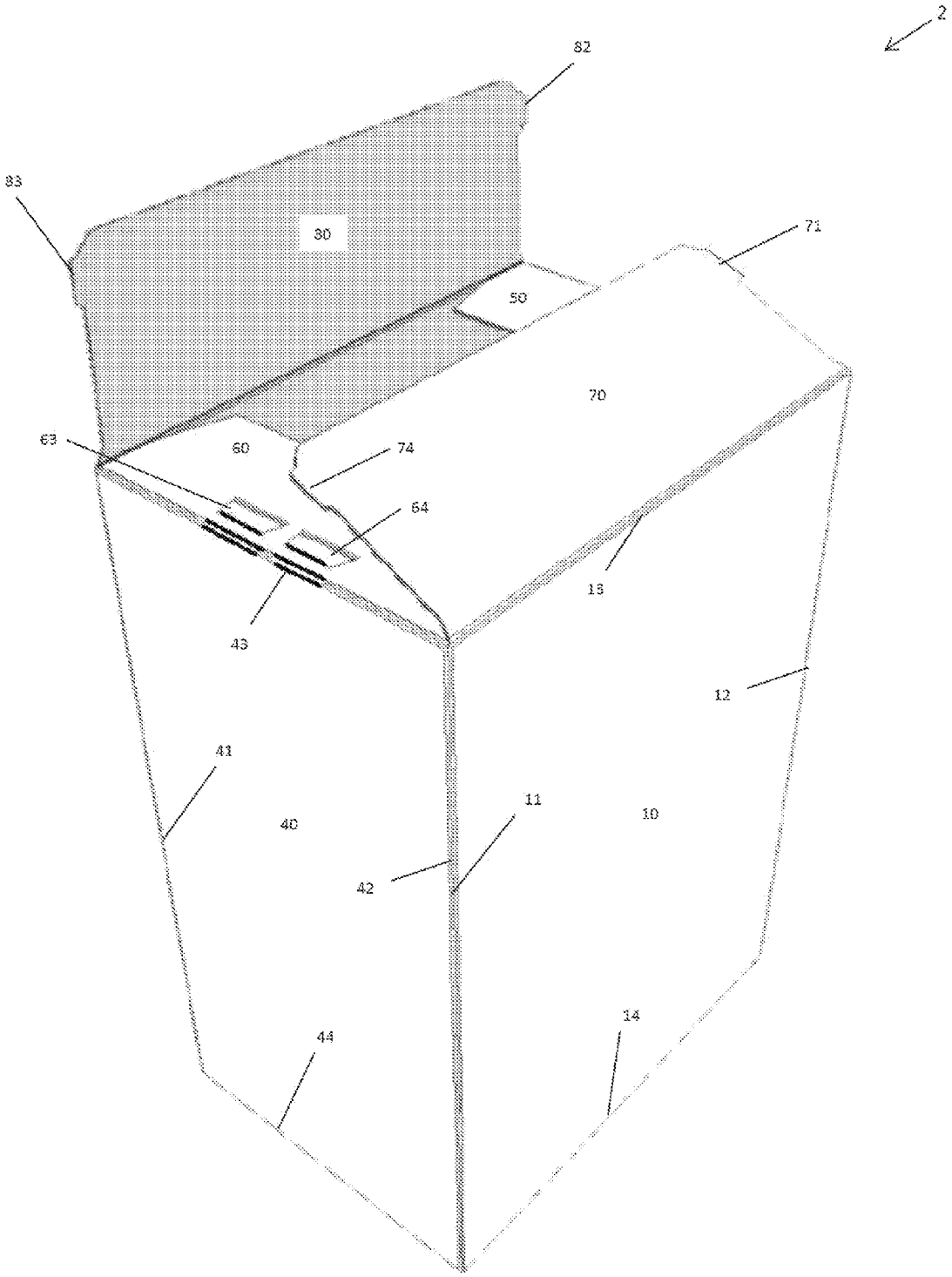
FIG. 2 is a perspective view of one embodiment of a formed container from the blank of FIG. 1.
Figure 3:
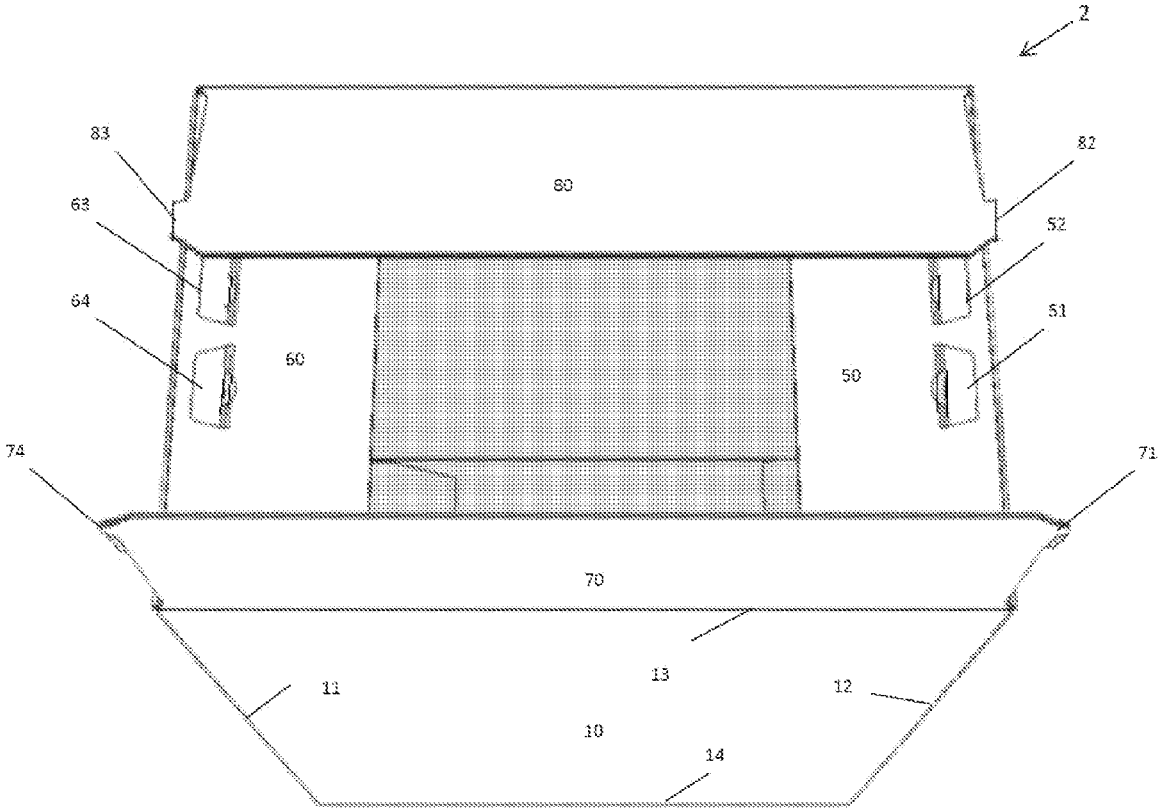
FIG. 3 is another perspective view of the formed container of FIG. 2.

In one embodiment, FIG. 1 illustrates a blank 1 for forming a container 2 (FIGS. 2 and 3). The blank 1 includes a first major panel 10, a second major panel 20, a first minor panel 30, and a second minor panel 40, with both major panels 10, 20 preferably identical in shape and size to each other and both minor panels 30, 40 preferably identical in shape and size to each other. The first minor panel 30 is connected between a second side edge 12 of the first major panel 10 and a first side edge 21 of the second major panel 20. The second minor panel 40 is connected to a first side edge 11 of the first major panel 10. Each of the four panels has its own respective first side edge 11, 21, 31, 41, second side edge 12, 22, 32, 42, top edge 13, 23, 33, 43, and bottom edge 14, 24, 34, 44.

A first slotted flap 50, having first and second slots 51, 52, is connected to the top edge 33 of the first minor panel 30 and a second slotted flap 60, having third and fourth slots 63, 64, is connected to the top edge 43 of the second minor panel 40. In one embodiment, the slots 51, 52, 63, 64 are trapezoidal apertures with the shorter bases of each trapezoidal slot positioned closer to the first and second minor panels 30, 40. A first tabbed flap 70, having first and fourth tabs 71, 74, is connected to the top edge 13 of the first major panel 10 and a second tabbed flap 80, having second and third tabs 82, 83 is connected to the top edge 23 of the second major panel 20. Both slotted flaps 50, 60 are preferably identical in shape and size to each other and both tabbed flaps 70, 80 are preferably identical to each other in shape and size.

Bottom closure flaps 90, 91 may be connected to the bottom edges 14, 24, 34, 44 of the respective major and minor panels 10, 20, 30, 40. A connecting flap 92, such as a glue flap 92, can be connected to the second side edge 22 of the second major panel 20 and may be adapted to be glued or otherwise connected to the first side edge 41 of the second minor panel 40 when the container 2 is constructed. Other structures aside from the glue flap 92, to connect the second major panel 20 to the second minor panel 40, are also envisioned, such as a flap disposed along the first side edge 41.

FIGS. 2 and 3 are perspective views of one embodiment of a container 2 formed from a blank 1 (such as the blank 1 illustrated in FIG. 1) in an assembled, partially opened state.

A method of the assembly of the blank 1 into the container 2 may be substantially as follows: the first and second major panels 10, 20 are folded toward one another relative to the first minor panel 30 as the second minor panel 40 is folded toward second major panel 20, whereupon the glue flap 92 (or other structure) is folded inwardly relative to the second major panel 20 and attached to the first side edge 41 of the second minor panel 40. Bottom closure flaps 90, 91 are each folded inwardly toward the center of container 2 and sealed shut through interlocking mechanisms on the flaps 90, 91 and/or an adhesive, or the like. The first and second slotted flaps 50, 60 are also folded inwardly, whereupon the first and second tabbed flaps 70, 80 are folded inwardly over the slotted flaps. Optionally, once the container 2 has been filled with an intended product, such as cereal, crackers, cookies, baking mixes, or the like, the flaps 70, 80 may be adhered or otherwise secured to the flaps 50, 60 such that the container 2 may be shipped and transported securely.

Returning to FIGS. 2 and 3, illustrating one embodiment of the container 2, the tabbed flaps 70, 80 are shaped and positioned such that the tabs 71, 74, 82, 83 disposed thereon may engage with the slots 51, 52, 63, 64 disposed on the slotted flaps 50, 60. In one embodiment of a method of using the container 2, when the tabbed flaps 70, 80 are moved to a closed position, over the slotted flaps 50, 60, a light compressive force on a central region of each of the tabbed flaps 70, 80 will cause the tabbed flaps 70, 80 to deflect concavely into the inner volume of container 2, thereby reducing the linear profile of each tabbed flap 70, 80 from tab to tab (i.e., shortening the distance between tabs 74 and 71, and the distance between tabs 82 and 83), and thereby allowing the tabs 71, 74, 82, 83 to move into their respective slots 51, 64, 52, 63. Conversely, when the tabbed flaps 70, 80 are engaged with the slotted flaps 50, 60, a light tension force on a central region of each of the tabbed flaps 70, 80 will cause the tabbed flaps 70, 80 to deflect convexly and outwardly (i.e., away from the inner volume of container 2), thereby causing a similar reduction in the tab-to-tab linear profile of each tabbed flap 70, 80, and thereby allowing the tabs 71, 74, 82, 83 to snap out of their respective slots 51, 64, 52, 63. Thus, container 2 may be simply opened and closed by the consumer using as little force as a single finger to close or open each of the flaps 70, 80. Additionally, container 2 eliminates the need for the consumer to prepare tuck slots by tearing perforated cuts disposed along a flap, as is required in the prior art.

Alternatively, in another embodiment of using the container 2, the container 2 may be closed by placing a light compressive force on a region of the tabbed flaps 70, 80 adjacent each one of the tabs 71, 74, 82, 83. Each light compressive force will create a localized concave deflection on the tabbed flaps 70, 80 into the inner volume of container 2, thereby, similar to the previously described method, reducing the linear profile of each tabbed flap 70, 80 from tab to tab (i.e., shortening the distance between tabs 74 and 71, and the distance between tabs 82 and 83), and thereby allowing the tabs 71, 74, 82, 83 to move into their respective slots 51, 64, 52, 63. Conversely, when the tabbed flaps 70, 80 are engaged with the slotted flaps 50, 60, a light tension force on a region of the tabbed flaps 70, 80 adjacent each one of the tabs 71, 74, 82, 83 will cause the tabbed flaps 70, 80 to deflect convexly and outwardly (i.e., away from the inner volume of container 2), thereby causing a similar reduction in the tab-to-tab linear profile of each tabbed flap 70, 80, and thereby allowing the tabs 71, 74, 82, 83 to snap out of their respective slots 51, 64, 52, 63. This method of opening container 2 will be especially applicable to envisioned embodiments comprised of thicker, sturdier materials, where a single, light compressive force on a central region of each tabbed flap 70, 80 may not create a sufficient deflection to allow engagement and subsequent disengagement from the tabs 71, 74, 82, 83 to their respective slots 51, 64, 52, 63.

It should be noted that, once the container 2 is formed, and is filled with a product at the manufacturer, the flaps are closed for shipping to the eventual end-user. In one example, the flaps may be closed using a light adhesive positioned on at least a portion of the underside of flaps 70, 80 which contact slotted flaps 50, 60, though it is preferred that the tabs 71, 74, 82, 83 themselves remain free of adhesive to minimize potential damage of the tabs upon opening the flaps 70, 80 and detachment of the adhesive. In this adhered position, the tabs and slots may be engaged with one another or merely positioned such that, for example, the tabs are positioned directly above the slots. Upon receipt of the container, and upon first opening of the container, the end-user may apply a light pulling force to a central region of each tabbed flap 70, 80 to detach the adhesive connection between the slotted flaps 50, 60 and tabbed flaps 70, 80. The container 2 may then be re-closed using the above-described methods or the like.

The container 2 of the present invention provides a flap design which provides ease of use to the consumer while also providing a reliable, recloseable and secure closure. Moreover, because the tabbed flaps 70, 80 do not need to overlap one another, less raw material can be used per blank 1, resulting in a decreased use in raw materials, particularly in instances where the present invention is used for large-scale production goods such as foodstuffs. Using fewer raw materials provides benefits to the environment, in that less paper products are required, and provides decreased cost to the manufacturer, and ultimately, to the product producer (e.g., cereal manufacturer, etc.) and the consumer.

Further, container 2 provides additional benefits over current containers used for cereal and like products. Specifically, for example, the tabbed flaps 70, 80, since they do not overlap when in the closed position, can provide a flat top surface of the container 2. Thus, multiple containers can be stacked on top of one another in a safe and stable manner. This is particularly important when stacking the containers on a pallet, such that the containers can be stacked in an organized, safe and stable manner without the need for additional packaging and/or stabilizing features (e.g., larger boxes containing numerous containers 2, dividers, materials forming a perimeter around a pallet, or the like). In contrast, current boxes used for cereal and the like include an overlap of the top flaps which results in an uneven top surface and thus produces an unstable stacking arrangement. As such, additional packaging and/or stabilizing features must be used to hold stacks of the current boxes together. While such additional packaging could be used as desired by the manufacturer, such additional packaging can be eliminated with the present invention, thereby allowing for a less expensive and more environmentally friendly method of manufacture, shipping, and delivery.

The container 2 of the present invention may be formed from a variety of materials including corrugated fiberboard, microflute and miniflute, paperboard, other types of paper-based materials, flexible and/or elastic plastics and metals, or a combination of any of the above. In a preferred embodiment, the container 2 of the present invention may be formed from a first corrugated structure of microflute corrugations and a second structure including an exterior sheet of paperboard which may present a smooth exterior surface for the placement of product graphics and information or the like. It is further envisioned that the material used to form the container 2 may vary in weight, density, thickness, and other such dimensions dependent upon the intended use of the container 2.

While the slots 51, 52, 63, 64 are illustrated as trapezoidal in shape, with the shorter bases of each trapezoidal slot positioned closer to the first and second minor panels 30, 40, any desired shape may be used such as for example, square, rectangular, semicircular, multi-sided polygonal, or the like. The particular shape of the slots notwithstanding, by providing slots with relatively larger areas, as opposed to perforated slits, it has been found that insertion and retention of the tabs can be more easily achieved and be more secure, reliable and repeatable.

Similarly, the tabbed flaps 70, 80 are illustrated as having a taper along their side edges such that the tabs 71, 74, 82, 83 may extend from and be disposed at the leading edge corners of the flaps 70, 80 and be capable of freely engaging with their respective slots 51, 64, 52, 63 without interference from the side edges of the flaps 70, 80. Though, again, the side edges and the actual positioning of the tabs may vary from the exemplary embodiment illustrated, the respective tabs and slots should easily engage one another regardless of the positioning desired. The tabs 71, 74, 82, 83 are illustrated as being substantially trapezoidal, with the larger bases of each tab connected to the sides of the tabbed flaps 70, 80, thereby allowing the tabs to more easily deflect and engage with their respective slots 51, 64, 52, 63, though once again, the actual shape of the tabs may vary as desired and may be, for example, square, rectangular, semicircular, multi-sided polygonal, or the like.

Other variations to the embodiments described herein are also envisioned. For example, although the embodiment shown has been described as providing a top-fill configuration, alternative designs can also be employed that otherwise incorporate the tab/slot closure feature of the present invention, such as containers using the closure feature on a side or front of the box. Alternative designs may even incorporate the closure feature of the present invention on multiple sides of a container. In addition, while the container has been shown as assuming a rectangular shape, a variety of other shapes are also acceptable, as are any size or volume. Also, the present invention may be constructed from materials other than paperboard or cardboard, such as plastics and certain metals.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A blank for forming a container, the blank comprising:

a first major panel having first and second side edges and top and bottom edges;

a second major panel having first and second side edges and top and bottom edges;

a first minor panel connected between the second side edge of the first major panel and the first side edge of the second major panel;

a second minor panel connected to the first side edge of the first major panel and connectable to the second side edge of the second major panel;

a first slotted flap connected at a top edge of the first minor panel, the first slotted flap including a central region having first and second slots;

a second slotted flap connected at a top edge of the second minor panel, the second slotted flap including a central region having third and fourth slots;

a first tabbed flap connected at the top edge of the first major panel and extending therefrom to a leading edge, the leading edge having first and fourth tabs positioned at opposite corners of the leading edge;

a second tabbed flap connected at the top edge of the second major panel and extending therefrom to a leading edge, the leading edge having second and third tabs positioned at opposite corners of the leading edge;

wherein the tabs and slots are positioned relative to one another such that, with the second minor panel connected to the second side edge of the second major panel, the first tab can cooperate with the first slot, the second tab can cooperate with the second slot, the third tab can cooperate with the third slot, and the fourth tab can cooperate with the fourth slot;

wherein, with the second minor panel connected to the second side edge of the second major panel, the first and second tabbed flaps deflect when a compressive force is applied along the leading edge of each tabbed flap such that, upon deflection of the tabbed flaps, each respective tab cooperates with its respective slot, wherein the first, second, third, and fourth tabs are disposed on their respective tabbed flaps in a manner such that each tab tapers from the leading edge; and wherein the first, second, third, and fourth slots are disposed on their respective slotted flaps in a manner such that each slot tapers toward the top edges of the first or second minor panels, respectively.

2. The blank of claim 1, wherein the leading edges of the first and second tabbed flaps do not overlap with one another when the respective tabs are in cooperation with their respective slots.

3. The blank of claim 1, wherein the first and second slotted flaps and first and second tabbed flaps are connected to the top edges of the respective first and second major panels and first and second minor panels through a hinged relationship.

4. The blank of claim 1, wherein the second minor panel is connectable to the second side edge of the second major panel by a connecting flap hingedly disposed along a first side edge of the second minor panel or the second side edge of the second major panel.

5. The blank of claim 1, further comprising:

a first major bottom panel connected at the bottom edge of the first major panel;

a second major bottom panel connected at the bottom edge of the second major panel;

a first minor bottom panel connected at a bottom edge of the first minor panel; and a second minor bottom panel connected at a bottom edge of the second minor panel.

6. The blank of claim 1, wherein the first, second, third, and fourth tabs are trapezoidally shaped and disposed on their respective tabbed flaps in a manner such that each tab tapers perpendicularly from the leading edge; and wherein the first, second, third, and fourth slots are trapezoidally shaped.

7. The blank of claim 6, wherein first and second side edges of the first and second tabbed flaps taper towards their respective leading edges.

8. A container including a first major panel, a second major panel, a first minor panel, a second minor panel, a bottom enclosure, and an opening defined by top edges of the first and second major panels and first and second minor panels, the container comprising:

a first slotted flap connected at the top edge of the first minor panel, the first slotted flap including a central region having first and second slots;

a second slotted flap connected at the top edge of the second minor panel, the second slotted flap including a central region having third and fourth slots;

a first tabbed flap connected at the top edge of the first major panel and extending therefrom to a leading edge, the leading edge having first and fourth tabs positioned at opposite corners of the leading edge;

a second tabbed flap connected at the top edge of the second major panel and extending therefrom to a leading edge, the leading edge having second and third tabs positioned at opposite corners of the leading edge;

wherein the first, second, third, and fourth tabs are disposed on their respective tabbed flaps in a manner such that each tab tapers from the leading edge;

wherein the first, second, third, and fourth slots are disposed on their respective slotted flaps in a manner such that each slot tapers toward the top edges of the first or second minor panels, respectively wherein the first tab can be positioned to cooperate with the first slot, the second tab can be positioned to cooperate with the second slot, the third tab can be positioned to cooperate with the third slot, and the fourth tab can be positioned to cooperate with the fourth slot;

wherein the first and second tabbed flaps deflect when a compressive force is applied along the leading edge of each tabbed flap such that, upon deflection of the tabbed flaps, the respective tab cooperates with the respective slot.

9. The container of claim 8, wherein the first and second slotted flaps and first and second tabbed flaps are connected to the top edges of the respective first and second major panels and first and second minor panels through a hinged relationship.

10. The container of claim 9, wherein the hinged relationship allows the first and second slotted flaps and first and second tabbed flaps to move from an open position, away from the opening, to a closed position over the opening.

11. The container of claim 10, wherein, with the slotted and tabbed flaps in the open position, the first, second, third and fourth tabs cannot cooperate with the respective first, second, third and fourth slots.

12. The container of claim 10, wherein, in the closed position, the first, second, third and fourth tabs cooperate with the respective first, second, third and fourth slots upon the application of the compressive force applied along the leading edge of each tabbed flap.

13. The container of claim 8, wherein the bottom enclosure includes:

a first major bottom panel connected at a bottom edge of the first major panel;

a second major bottom panel connected at a bottom edge of the second major panel;

a first minor bottom panel connected at a bottom edge of the first minor panel; and a second minor bottom panel connected at a bottom edge of the second minor panel, wherein the bottom enclosure defines a second opening defined by the bottom edges of the first and second major panels and first and second minor panels.

14. The container of claim 8, wherein the first tabbed flap is detachably secured to the first and second slotted flaps;

wherein the second tabbed flap is detachably secured to the first and second slotted flaps; and wherein the bottom enclosure is sealed.

15. A method of operating a container having a first major panel having first and second side edges and top and bottom edges, a second major panel having first and second side edges and top and bottom edges, a first minor panel having top and bottom edges connected between the second side edge of the first major panel and the first side edge of the second major panel, a second minor panel having top and bottom edges connected to the first side edge of the first major panel and connectable to the second side edge of the second major panel, a first slotted flap connected at a top edge of the first minor panel, the first slotted flap including a central region having first and second slots, a second slotted flap connected at a top edge of the second minor panel, the second slotted flap including a central region having third and fourth slots, a first tabbed flap connected at the top edge of the first major panel and extending therefrom to a leading edge, the leading edge having first and fourth tabs positioned at opposite corners of the leading edge, and a second tabbed flap connected at the top edge of the second major panel and extending therefrom to a leading edge, the leading edge having second and third tabs positioned at opposite corners of the leading edge, in which the first, second, third, and fourth tabs are disposed on their respective tabbed flaps in a manner such that each tab tapers from the leading edge, and in which the first, second, third, and fourth slots are disposed on their respective slotted flaps in a manner such that each slot tapers toward the top edges of the first or second minor panels, the method comprising the steps of:

folding the first and second slotted flaps inwardly toward an opening formed by the top edges of the major and minor panels, folding the first and second tabbed flaps inwardly toward the opening and upon the first and second slotted flaps, and applying compression forces upon regions adjacent the first, second, third, and fourth tabs along the leading edges of each of the first and second tabbed flaps, wherein each compression force causes a deflection in the first and second tabbed flaps such that each respective tab engages with its respective slot.

16. The method of claim 15, wherein the step of applying the compression forces includes:

applying a compression force upon regions adjacent the first and the fourth tabs along the leading edge of the first tabbed flap, wherein the compression forces cause localized deflections on the regions adjacent the first and fourth tabs such that each respective tab engages with its respective slot; and applying a compression force upon regions adjacent the second and the third tabs along the leading edge of the second tabbed flap, wherein the compression forces cause localized deflections on the regions adjacent the second and third tabs such that each respective tab engages with its respective slot.

17. The method of claim 15, wherein the step of applying the compression forces includes:

applying a compression force upon a region between the first and fourth tabs along the leading edge of the first tabbed flap, and applying a compression force upon a region between the second and third tabs along the leading edge of the second tabbed flap, wherein the compression forces cause localized deflections in the first and second tabbed flaps such that each respective tab engages with its respective slot.

18. The method of claim 15, after the step of applying the compression forces, further comprising the steps of:

applying tension forces upon regions adjacent the first, second, third, and fourth tabs along the leading edges of each of the first and second tabbed flaps, wherein each tension force causes a deflection in the first and second tabbed flaps such that each respective tab disengages from its respective slot.

19. The method of claim 18, wherein the step of applying the tension forces includes:

applying a tension force upon regions adjacent the first and the fourth tabs along the leading edge of the first tabbed flap, wherein the tension forces cause localized deflections on the regions adjacent the first and fourth tabs such that each respective tab disengages from its respective slot; and applying a tension force upon regions adjacent the second and the third tabs along the leading edge of the second tabbed flap, wherein the tension forces cause localized deflections on the regions adjacent the second and third tabs such that each respective tab disengages from its respective slot.

20. The method of claim 18, wherein the step of applying the tension forces includes:

applying a tension force upon a region between the first and fourth tabs along the leading edge of the first tabbed flap, and applying a tension force upon a region between the second and third tabs along the leading edge of the second tabbed flap, wherein the tension forces cause localized deflections in the first and second tabbed flaps such that each respective tab disengages from its respective slot.

* * * * *

UNITED STATES PATENT AND TRADEMARK OFFICE

CERTIFICATE OF CORRECTION

PATENT NO. : 9,016,556 B2
APPLICATION NO. : 14/193710
DATED : April 28, 2015
INVENTOR(S) : Lisa Hirsh It is certified that error appears in the above-identified patent and that said Letters Patent is hereby corrected as shown below:

On the Title page of the patent at (72) Inventor: delete "Paterson" and insert therefor --North Caldwell--.

Signed and Sealed this
Twenty-sixth Day of January, 2016

Michelle K. Lee

Michelle K. Lee
*Director of the United States Patent and Trademark Office*